US005263291A

United States Patent [19]

Knight

[11] Patent Number: 5,263,291

[45] Date of Patent: Nov. 23, 1993

[54] METHOD AND APPARATUS FOR CORROSION PROTECTION OF THE TERMINAL END OF A POST-TENSIONED TENDON

[76] Inventor: David W. Knight, 1210 Hamblen Rd., Suite 200, Kingwood, Tex. 77339

[21] Appl. No.: 969,973

[22] Filed: Nov. 2, 1992

[51] Int. Cl.[5] ..... E04C 3/10

[52] U.S. Cl. ..... 52/223.13

[58] Field of Search ..... 52/223.13, 223.14, 223.1; 264/228; 24/122.6

[56] References Cited

U.S. PATENT DOCUMENTS 4,918.887 4/1990 Davis et al. ..... 52/223.13
5,024,032 6/1991 Rodriguez ..... 52/223.13
5,072,558 12/1991 Sorkin et al. ..... 52/223.13
5,079,879 1/1999 Rodriguez ..... 52/223.13

*Primary Examiner*—Philip C. Kannan
*Attorney, Agent, or Firm*—Harrison & Egbert

[57] ABSTRACT

A post-tensioned anchor assembly having an anchor, a tendon affixed within the anchor and having an end extending outwardly from the anchor, and a cap affixed in direct electrical connection onto the tendon. The tendon is of an electrically conductive material. The cap covers the end of the tendon. The cap is made of an anodic material such as zinc or magnesium. The cap has an inner surface which matches a diameter of the tendon so that the inner surface is in surface-to-surface contact with the tendon. The cap can also be brazed to the tendon for establishing electrical contact.

19 Claims, 3 Drawing Sheets

METHOD AND APPARATUS FOR CORROSION PROTECTION OF THE TERMINAL END OF A POST-TENSIONED TENDON

FIELD OF INVENTION

The present invention relates to corrosion protection of the terminal end of a post-tensioned steel tendon by use of a protective cap. More specifically, it relates to a method for installing a specially designed cap member onto the terminal end of a post-tensioned steel tendon in existing or new service. This cap member provides corrosion protection by 1) sealing the terminal end of the steel tendon where in contact with weathered concrete grout, and 2) when made of an anodic material, by providing a sacrificial anode to prevent corrosion of the terminal end of the tendon and the adjacent anchor assembly should the concrete grout cover ever become compromised.

BACKGROUND OF THE INVENTION

Post-tensioning is a type of steel reinforcement for concrete structures. It typically refers to the method of placing wet concrete around unstressed tendons that have been coated with grease and encased in a plastic sheath. After sufficient hardening of the concrete the tendons are pulled, or post-tensioned, to provide strength to the structure. The tendons are then anchored and cut off just inside the face of the structure in what are termed grout pockets. The grout pockets surrounding these tendon ends are then filled with a concrete grout.

The basic procedures used in prestressing or post-tensioning concrete structures have been known since the 1940's, and development of those procedures is traceable to the late 1920's. However, general acceptance and extensive use of post-tensioning did not begin until the late 1960's or early 1970's. The use of post-tensioning is especially suited to slab construction such as multi-level floor slabs in parking garages and buildings, or slabs-on-ground such as in residential construction. The post-tensioned slab-on-ground foundation for residential construction has become the system of choice for many builders in areas that have a relatively flat terrain. The primary reason for this is its economy and ease of installation.

Corrosion protection is provided for most of the tendon length by a coating of grease and a plastic sheath installed by the manufacturer. However, the plastic sheath must be removed at each terminal end for anchorage. This results in a length of bare tendon and an anchor assembly that are protected only by the concrete grout installed by the tensioner at the time of stressing. Corrosion problems typically result due to inadequate concrete covering the terminal end of the tendon. The end of the tendon must be cut off a sufficient distance inside the face of the slab to prevent corrosion from starting and cracking the concrete grout seal. The required clearance distance for reinforcing steel from an exterior formed concrete surface is typically 2-inches. This distance is necessary to prevent contact of the steel with weathered, or carbonated, concrete. Carbonated concrete is concrete that has reacted with $CO_2$ in the atmosphere over a period of time. This carbonation lowers the pH of the concrete to a level that is no longer non-corrosive to steel, and the steel begins to corrode. This is a condition that is beginning to affect numerous concrete structures where steel is present within the zone of carbonation. This condition is especially serious in post-tensioned structures since most pocket formers for post-tensioning anchorages make a pocket only 1.5-inches deep, and only recently has a tool become available for cutting the tendon off more than about ¼-inch inside the pocket.

Although designed to be maintenance free for decades, it became apparent in the early 1980's that structures installed in corrosive environments were failing after only a few years due to failure of the grout seal and severe corrosion at the terminal end anchorages. Subsequently, coated tendons and encapsulating anchors were developed and are now used for corrosive environments. However, residential construction has continued with very little change from the methods used in the 1960's and 1970's. It has now become apparent that premature failure of concrete grout seals is beginning to cause failure of terminal end anchorages in all types of structures, and specifically in large numbers of single and multi-family residential structures. Most owners of post-tensioned structures are unaware of the type of reinforcing they have, and are not knowledgeable about inspection or maintenance of the terminal ends of the post-tensioned tendons.

The present invention is directed at the large numbers of tendons in new and existing service that are in need of additional protection to prevent corrosion and eventual failure.

SUMMARY OF THE INVENTION

The present invention provides a methods and apparatus for protecting the terminal ends of post-tensioned tendons in new or existing service from corrosion and failure. This protection is accomplished in the preferred embodiment by the installation of a cap member made of an anodic material such as magnesium or zinc. The cap member serves a dual function; 1) the cap shape provides a cover so that steel within the zone of carbonation will not be subjected to corrosion that would otherwise compromise the concrete grout seal, and 2) should the concrete grout seal be compromised for any reason, the anodic material will corrode preferentially to the steel and provide extended cathodic protection to the tendon and anchor components. The exterior of the cap member may be of various shapes and textures designed to provide a specific anode surface area, or may be cylindrical or prismatic. The interior of the cap will typically be cylindrical with either straight or tapered walls to provide the best fit to the tendon end being protected.

Prior to installation, the tendon end and exposed anchor components must be thoroughly prepared. This preparation should include chipping or scraping of all rust and scale from the exposed steel components in the grout pocket. Additionally, these components should be sandblasted to a completely clean condition. The cap may then be installed onto the tendon end by using electrically conductive adhesives, or by soldering or brazing with special low temperature alloys. It may also be manufactured with internal high strength steel threads and then be screwed onto the tendon end. Additionally, the cap may be manufactured with an embedded lead wire, where the lead wire is brazed to the very tip of the tendon end and the cap is slipped on after connection of the lead wire. After installation of the protective cap, a non-shrink concrete grout seal should be installed in the grout pocket.

This invention is not intended to replace the need for a concrete grout seal. However, it is intended to supplement this grout seal by 1) providing a cover so that steel within the zone of carbonation will not be subjected to corrosion, and 2) should the concrete grout seal be compromised for any reason, the anodic material will corrode preferentially to the steel and provide cathodic protection to the tendon and anchor components. The installation of this protective cap is anticipated to provide a greatly extended service life to tendons in existing or new structures that might otherwise fail catastrophically causing both property damage and personal injury.

DESCRIPTION OF THE PREFERRED EMBODIMENT

Figure 1:
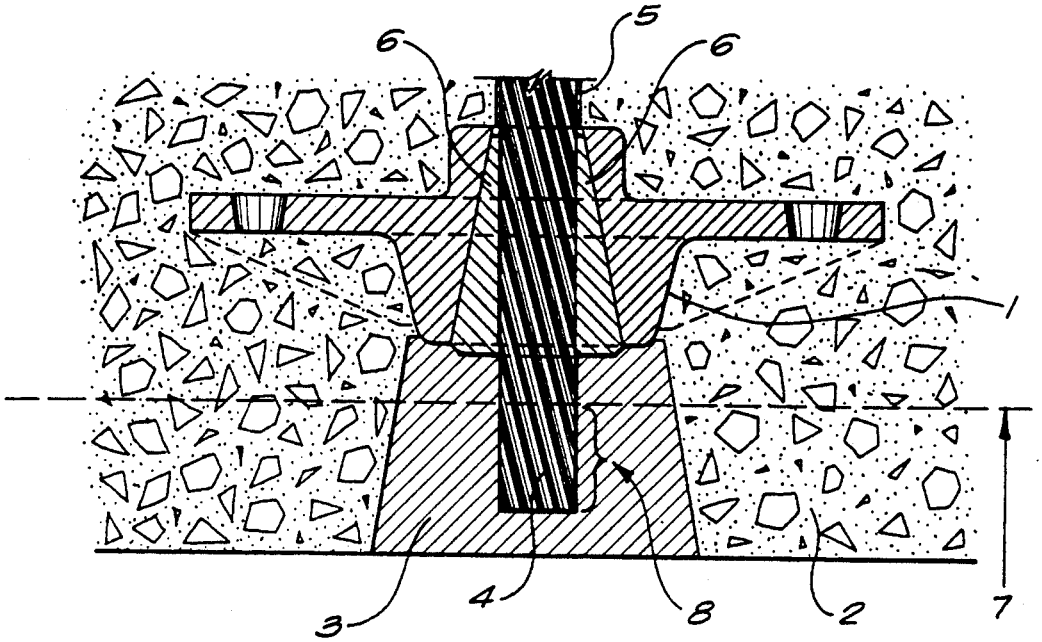
FIG. 1 is a cross-sectional plan view of the prior art installation of a post-tensioned anchorage assembly showing the typical components found in most post-tensioned installations at the time of construction. Additionally, the typical depth of concrete carbonation, or weathering, and the steel within this zone of carbonation are shown in this figure.

Referring to the drawings by reference numbers, FIG. 1 shows the typical prior art installation of a post-tensioned anchorage. In FIG. 1, anchor body 1 is embedded in the concrete structure 2 with steel tendon 4 protruding through anchor body 1 and anchored under significant tension with anchor wedges 6. Steel tendon 4 has been cut short of the face of the structure and the terminal end of steel tendon 4 has been sealed with a concrete grout 3. Corrosion protection for most of the length of steel tendon 4 is provided by the grease filled plastic sheath 5 installed by the manufacturer of the steel tendon 4. Also shown in FIG. 1 is the approximate depth of weathering, or the zone of carbonation 7, and the amount of steel tendon 8 within this zone of carbonation 7.

Figure 2:
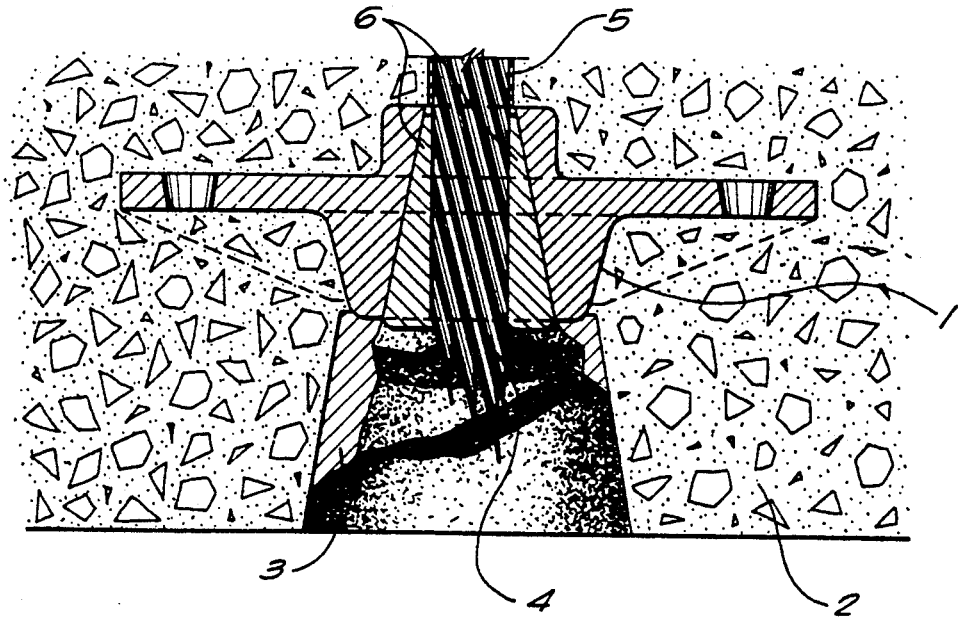
FIG. 2 is a cross-sectional plan view showing the typical extent of corrosion present in the anchorage assembly just prior to catastrophic failure and loss of tension forces in the tendon.

FIG. 2 shows the resulting corrosion that occurs over time due to lack of adequate concrete grout 3 covering the terminal end of the steel tendon 4. The extent of corrosion in a particular anchorage is influenced by a number of factors, namely the quality of the concrete grout 3 and the amount of steel tendon 8 within the zone of carbonation 7. The first sign of corrosion generally appears as a small spalling of concrete grout from the tip of the steel tendon 4. As this progresses, corrosion of the steel tendon increases and expansive forces spall most of the concrete grout 3 from the anchor pocket as shown in FIG. 2. With no protection from corrosive forces, the steel tendon 4, as well as anchor body 1 and anchor wedges 6, corrode heavily and eventually fail in a catastrophic manner.

Figure 3:
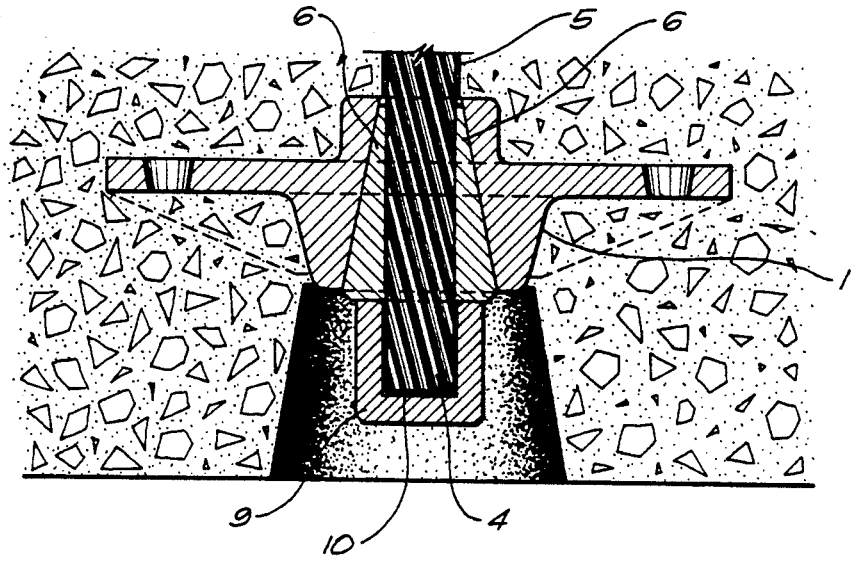
FIG. 3 is a cross-sectional plan view of a typical post-tensioned anchorage assembly showing the present invention installed on the terminal end of the tendon. The pocket in this figure has not yet been resealed with concrete grout.

The present invention as shown in FIG. 3 utilizes a protective cap 9 made of an anodic material, such as magnesium or zinc, to seal the terminal end of the steel tendon from the effects of carbonation 7 while at the same time providing additional extended cathodic protection to the steel components of the anchorage assembly if the concrete grout seal 3 is compromised for any reason. The protective cap 9 can be installed on steel tendons 4 that are in various corroded conditions by custom fitting the interior of the cap 9. Tendons having any appreciable corrosion will require sandblasting to a clean condition prior to installation of the protective cap.

FIG. 3 is a cross-sectional plan view of a typical post-tensioned anchorage where the present invention, a protective cap 9 made of anodic material, has been installed on the terminal end of the steel tendon 4. The protective cap has been low temperature brazed 10 so as to be electrically conductive and firmly affixed to the steel tendon 4. It can be also seen in FIG. 3 that the protective cap 9 can be affixed to the end of the tendon 4 in a variety of other ways. For example, instead of brazing, the protective cap may be affixed by an electrically conductive adhesive to the end of the tendon 4. As will be described in connection with FIG. 8, the cap 9 may be press fitted onto the end of the tendon 4 so as to establish a strong surface-to-surface contact between the inner surface of the cap 9 and the outer surface of the tendon 4. The cap 9 may also include a high strength steel thread, which is formed therein, so as to threadedly engage the outer surface of the tendon 4. Additionally, the cap 9 can also be affixed to the tendon 4 by fastening a lead wire to the tendon 4. This lead wire can extend from the tendon 4 and be embedded within the cap 9. As such, the manner of affixing, as shown in FIG. 3, should not be construed as a specific limitation to the present invention. A variety of other techniques can be employed so as to suitably affix the cap member 9 in electrical contact with the end of the tendon 4. It can be seen that the cap 9 is affixed to the end of the tendon 4 so as to be in abutment with the anchor wedges 6.

Figure 4:
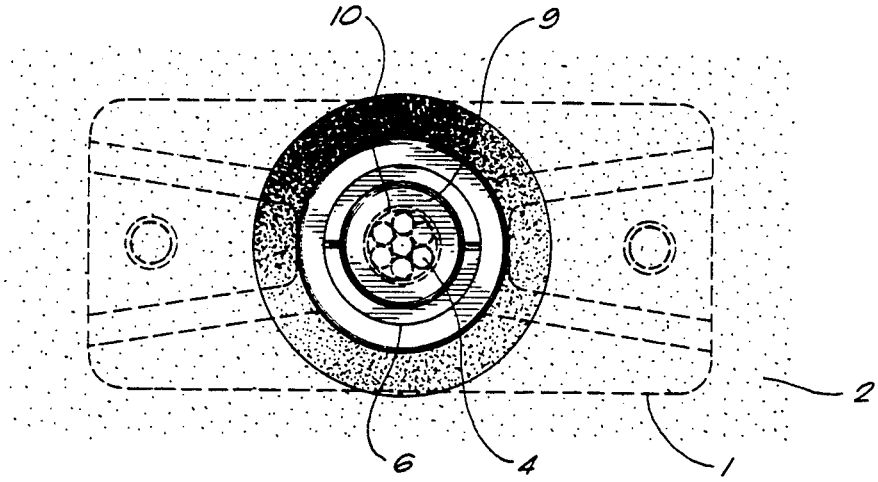
FIG. 4 is an elevation view of the side of the structure at the post-tensioned anchorage showing the present invention installed on the terminal end of the tendon. The pocket in this figure has not yet been resealed with concrete grout.
Figure 5:
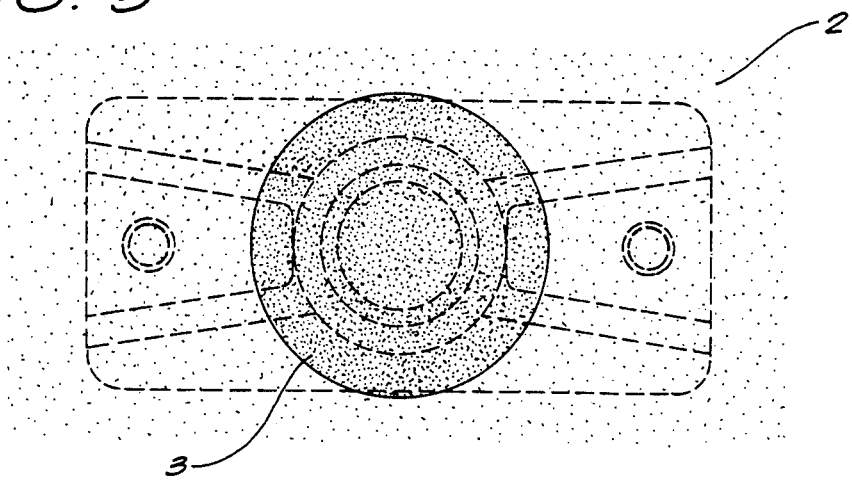
FIG. 5 is an elevation view of the side of the structure at the post-tensioned anchorage after the pocket has been resealed with concrete grout.

FIG. 4 is an elevation view of the side of the concrete structure 2 at the post-tensioned anchorage showing the protective cap 9 installed on the terminal end of the steel tendon 4. The pockets in FIGS. 3 and 4 have not yet been resealed with concrete grout 3. After installation of the concrete grout 3 the post-tensioned anchorage appears as shown in FIG. 5, an elevation view.

The concrete grout seal 3 is expected to be the first line of protection against corrosion, and with the protective cap 9 in place, should never fail due to expansive forces resulting from corrosion of the steel tendon 4. However, if excessive movements occur in the main structure, cracks may develop in this seal and it may become compromised. Should this occur, the anodic material of the cap 9 will provide extended cathodic protection to the steel components of the anchorage and allow a significant amount of time for discovery of damage to the concrete grout seal 3, which can then be replaced without permanent damage occurring to the structure.

Figure 6:
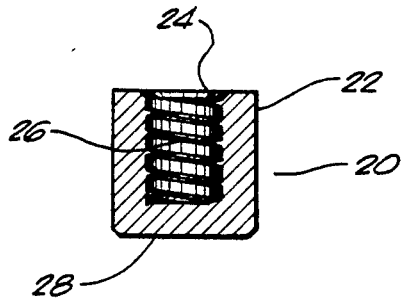
FIG. 6 is a cross-sectional view showing an alternative embodiment of the cap member of the present invention with internal threads for engaging the end of the tendon.

FIG. 6 illustrates a cross-sectional view of a cap 20 in accordance with an alternative embodiment of the present invention. It can be seen that the cap 20 has a generally closed cylindrical outer surface 22 and a closed cylindrical inner surface 24. The inner surface of the cap member 20 has a high strength steel thread extending therein. The cap 20 can be formed by a variety of machining processes. The placement of the high strength steel threads 26 on the interior of cap member 20 allows the cap member 20 to be threadedly affixed, in electrical contact, with the end of the tendon. The inner surface 24 of cap member 20 should have a diameter which generally corresponds to the diameter of the tendon to which it is affixed. The closed end 28 of cap member 20 allows the cap member 20 to properly cover the end of the tendon.

Figure 7:
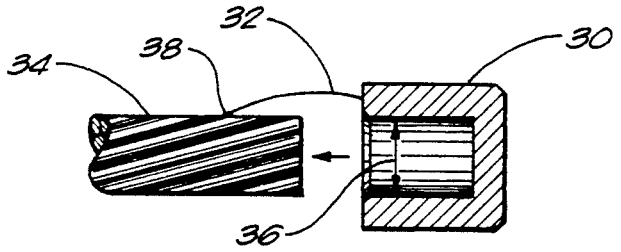
FIG. 7 is a cross-sectional view of an alternative embodiment of the cap member of the present invention shown as attached by a lead wire to an end of the tendon.

FIG. 7 shows another alternative embodiment of the present invention. The alternative embodiment of FIG. 7 has a cap member 30 which is affixed by a lead wire 32 to the tendon 34. The cap member 30 has an interior diameter 36 which generally corresponds to the outer diameter of the tendon 34. One end of the lead wire 32 is embedded within the body of cap member 30. Another end 38 of the lead wire 32 is attached, in electrical contact, with an outer surface of the tendon 34. Specifically, the end 38 of lead wire 32 can be affixed by soldering, or other fastening processes, so as to secure the end 38 to the surface of the tendon 34. As can be seen, the interior 36 of cap member 30 will slide over the end of the tendon 34 so as to properly cover the end of the tendon.

Figure 8:
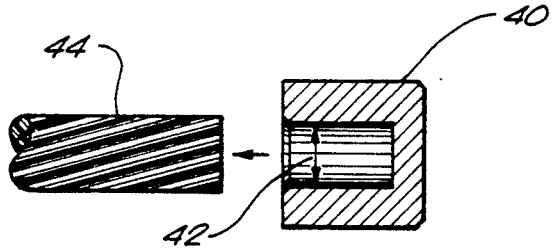
FIG. 8 is a cross-sectional view of another alternative embodiment of the cap member of the present invention shown as in a proper condition for engagement with an end of the tendon. The cap member has an interior surface which is of a smaller diameter than the diameter of the tendon.

FIG. 8 shows still another alternative embodiment of the present invention. The embodiment of FIG. 8 has a cap member 40 which has an interior 42 of a lesser diameter than the diameter of the tendon 44. The cap member 40 can be press fitted onto the end of the tendon 44 so that the inner surface 42 of the cap member 40 is in strong surface-to-surface contact with the surface of the tendon 44. A variety of techniques can be employed so as to properly press fit the cap member 40 onto the end of tendon 44.

The foregoing disclosure and description of the invention is explanatory and illustrative thereof. Variations of the illustrated construction or in the steps of the described method may be made within the scope of the appended claims without departing from the spirit of the present invention. The present invention should only be limited by the following claims.

I claim:

1. A method of protecting a steel anchorage assembly from corrosion, said steel anchorage assembly having a post-tensioned tendon received within an anchor, said tendon having an end extending outwardly of the anchor, said method comprising the steps of:

fabricating a cap member of an anodic material, said cap member having a size suitable for fitting around the end of the tendon;

positioning said cap member on the end of the tendon so as to cover the end; and affixing said cap member in electrical contact with the end of the tendon.

2. The method of claim 1, further comprising the steps of:

forming a pocket adjacent the steel anchorage assembly such that said pocket surrounds the end of the tendon; and installing a grout seal into the pocket after the step of affixing.

3. The method of claim 1, said step of affixing comprising:

brazing said cap member onto the end of the tendon.

4. The method of claim 1, said step of affixing comprising:

fastening said cap member onto the end of the tendon with an electrically conductive adhesive.

5. The method of claim 1, said step of fabricating comprising:

forming said cap member with an exterior surface and an interior surface, said interior surface having a diameter less than a diameter of the tendon.

6. The method of claim 5, said step of affixing comprising:

pressing said cap member onto the end of the tendon such that said cap member is in electrical contact with the tendon.

7. The method of claim 1, said step of fabricating comprising:

embedding a lead wire into said cap member.

8. The method of claim 7, said step of affixing comprising:

connecting said lead wire to the end of the tendon so as to electrically connect said cap member to the tendon.

9. The method of claim 1, said step of fabricating comprising:

forming steel threads on an interior surface of said cap member.

10. The method of claim 9, said step of affixing comprising:

screwing said cap member onto the end of the tendon so as to directly electrically connect said cap member to a surface of the tendon.

11. A cap member for an end of a post-tensioned tendon comprising:

a cap having an inner surface and an outer surface, said interior surface suitable for covering the end of the tendon, said cap being of an anodic material; and a lead wire embedded within said cap, said lead wire suitable for electrical connection to the end of the tendon.

12. The cap member of claim 11, said anodic material being an alloy selected from the group consisting of: magnesium and zinc.

13. The cap member of claim 11, said interior surface of said cap having steel threads formed therein, said steel threads suitable for electrical connection to a surface of the tendon.

14. The cap member of claim 11, said inner surface having a closed cylindrical configuration, said outer surface having a closed cylindrical configuration, said inner surface having a diameter corresponding to a diameter of the tendon.

15. The assembly of claim 11, said cap fastened onto the end of the tendon with an electrically conductive adhesive.

16. The assembly of claim 11, said cap brazed to said tendon.

17. A post-tension anchor assembly comprising:

an anchor;

a tendon affixed within said anchor, said tendon having an end extending outwardly from said anchor, said tendon being of an electrically conductive material; and a cap affixed in direct electrical connection onto said tendon, said cap covering said end of said tendon, said cap comprised of an anodic material.

18. The assembly of claim 17, said anodic material being an alloy being selected from the group consisting of: magnesium and zinc.

19. The assembly of claim 17, said cap having an inner diameter generally matching a diameter of said tendon, said inner surface in surface-to-surface contact with said tendon.

* * * * *